United States Patent [19]

Henzel

[11] Patent Number: 5,023,228

[45] Date of Patent: Jun. 11, 1991

[54] SUBBING LAYER FOR DYE-DONOR ELEMENT USED IN THERMAL DYE TRANSFER

[75] Inventor: Richard P. Henzel, Webster, N.Y.

[73] Assignee: Eastman Kodak Company, Rochester, N.Y.

[21] Appl. No.: 537,176

[22] Filed: Jun. 13, 1990

[51] Int. Cl.[5] ..... B41M 5/035; B41M 5/26

[52] U.S. Cl. ..... 503/227; 8/471; 428/195; 428/500; 428/532; 428/913; 428/914

[58] Field of Search ..... 8/471; 428/195, 500, 428/532, 913, 914; 503/227

[56] References Cited

U.S. PATENT DOCUMENTS 4,695,288 9/1987 Ducharms ..... 8/471
4,700,208 10/1987 Vanier et al. .
4,716,144 12/1987 Vanier et al. ..... 503/227

*Primary Examiner*—Bruce H. Hess
*Attorney, Agent, or Firm*—Harold E. Cole

[57] ABSTRACT

A dye-donor element for thermal dye transfer comprising a poly(ethylene terephthalate) support having thereon, in order, a subbing layer and a dye layer comprising a dye dispersed in a cellulosic binder, and wherein said subbing layer comprises a copolymer of vinyl alcohol and an alkyl ester of vinyl alcohol, such as vinyl acetate.

20 Claims, No Drawings

SUBBING LAYER FOR DYE-DONOR ELEMENT USED IN THERMAL DYE TRANSFER

This invention relates to dye-donor elements used in thermal dye transfer, and more particularly to the use of a particular subbing layer between a poly(ethylene terephthalate) support and a dye layer comprising a dye dispersed in a cellulosic binder.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

A problem has existed with the use of dye-donor elements for thermal dye-transfer printing because a thin support is required in order to provide effective heat transfer. For example, when a thin polyester film is employed, there is a greater tendency for layer delamination.

In U.S. Pat. No. 4,695,288, various vinylidene chloride copolymers are described as subbing layers for thermal dye transfer dye donor elements. While these materials have proven to be effective for adhesion purposes at a given level, the amount of density transferred has been found to be dependent upon the amount of subbing layer coated. This would create a problem in having to accurately control the amount of subbing material to be coated. It would be desirable to provide a subbing layer for dye-donor elements used in thermal dye transfer which would provide superior adhesion between a poly(ethylene terephthalate) support and a dye layer comprising a cellulosic binder and which would be less dependent upon the amount of subbing layer coated.

In U.S. Pat. No. 4,700,208, various hydrophilic dye-barrier/subbing layers comprising various acrylic materials for dye-donor elements are described. While these materials have proven to be effective for adhesion purposes, they are coated from aqueous solutions. This could be a disadvantage when coating a dye layer on top of the subbing layer from an organic solvent which would require a change in coating machine. In addition, these hydrophilic materials are not readily available commercially. It would be desirable to provide subbing materials which are readily available and cheaper than those of the prior art and which can be coated from organic solvents.

In U.S. Pat. No. 4,716,144, a mixture of poly(vinyl alcohol) and poly(vinyl acetate) is disclosed for use as a barrier layer on top of a subbing layer for a dye-donor element. There is a problem with those materials, however, in that they cause sticking of the dye layer to the receiving layer during the dye transfer step. It would be desirable to provide a subbing layer for a dye-donor element which would have good adhesion and not cause sticking of the dye layer to the receiving layer during dye transfer.

A dye-donor element according to this invention for thermal dye transfer comprises a poly(ethylene terephthalate) support having thereon, in order, a subbing layer and a dye layer comprising a dye dispersed in a cellulosic binder, and wherein the subbing layer comprises a copolymer of vinyl alcohol and an alkyl ester of vinyl alcohol.

In a preferred embodiment of the invention, the copolymer has the general structure:

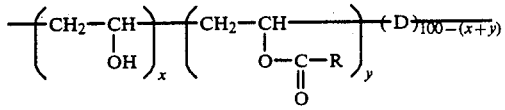

wherein:

R is a substituted or unsubstituted alkyl or alkylene group having from 1 to about 6 carbon atoms;

x is 5 to 25 mole percent;

y is 95 to 75 mole percent; and

D may optionally be a copolymerizable monomer.

In a preferred embodiment of the invention, the alkyl ester of vinyl alcohol is vinyl acetate.

Two commercially available poly(vinyl alcohol-co-vinyl acetate) materials which may be employed in the invention are:

1. Scientific Polymer Products, No. 379 Mole ratio alcohol:ester (9:91)
2. Scientific Polymer Products No. 380 Mole ratio alcohol:ester (18:82).

The copolymerizable monomer D in the above formula may be, for example, an alkyl acrylate or methacrylate such as methyl acrylate, ethyl acrylate, propyl acrylate, butyl acrylate, or butyl methacrylate; a vinyl ester, amide, nitrile, ketone, halide, ether, olefin, or diolefin as exemplified by acrylonitrile, methacrylonitrile, styrene, a-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinimide, N-vinylphthalimide, N-vinylpyrrolidone, 1,4-butadiene, or ethylene.

The subbing layer of the invention may be employed at any concentration which is effective for the intended purpose. In general, good results have been obtained at from about 0.005 to 0.5 g/m$^2$, preferably 0.02 to 0.02 g/m$^2$, of coated element.

Any cellulosic binder may be employed in the dye-donor element of the invention. For example, there may be employed cellulose acetate, cellulose triacetate (fully acetylated) or a cellulose mixed ester such as cellulose acetate butyrate, cellulose acetate hydrogen phthalate, cellulose acetate formate, cellulose acetate propionate, cellulose acetate pentanoate, cellulose acetate hexanoate, cellulose acetate heptanoate, or cellulose acetate benzoate. In a preferred embodiment, cellulose acetate propionate is employed.

The cellulosic binder of the invention may be employed at any concentration which is effective for the intended purpose. In general, good results have been obtained at from about 0.1 to about 5 g/m$^2$ of coated element.

Any dye can be used in the dye layer of the dye-donor element of the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

(magenta)

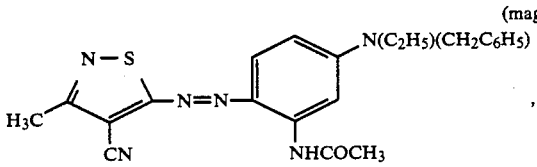

(yellow)

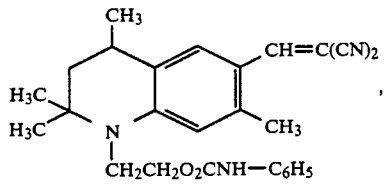

(cyan)

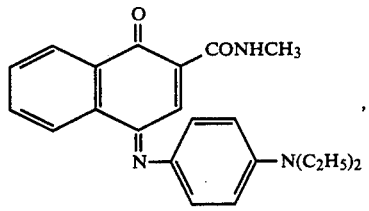

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye layer of the dye-donor element may be coated on the support or printed theron by a printing technique such as a gravure process.

The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 weight %, preferable 0.5 to 40, of the polymeric binder employed.

The dye-receiving element that is used with the dye-donor element of the invention comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head (F415 HH7-108) or a Rohm Thermal Head (KE 2008-F3).

A thermal dye transfer assemblage of the invention comprises a) a dye-donor element as described above, and
b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

A) Yellow dye-donor elements in accordance with the invention were prepared by coating the following layers in the order recited on a 6 um poly(ethylene terephthalate) support which had been subjected to a corona discharge treatment:

1) Subbing layer of copolymer of polyvinyl alcohol and polyvinyl acetate (1) and (2) identified above in the amounts shown in the Table, coated from butanone solvent; and
2) Dye layer containing the yellow dye identified below (0.15 g/m$^2$), and cellulose acetate propionate binder (2.5 % acetyl and 45% propionyl) (0.37 g/m$^2$) coated from a toluene, methanol and cyclopentanone solvent mixture (65/30/5).

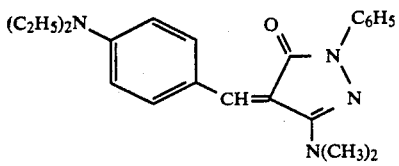

Yellow Dye

On the backside of the dye-donor element was coated:

1) a subbing layer of duPont Tyzor TBT® titanium tetra-n-butoxide (0.12 g/m$^2$) coated from a n-propyl acetate and 1-butanol solvent mixture; and
2) a slipping-layer of Emralon 329® polytetrafluoroethylene dry film lubricant (Acheson Colloids)(0.54 g/m$^2$) coated from a n-propyl acetate, toluene, and methanol solvent mixture.

B) A control dye-donor element (C-1) was prepared similar to A), except that there was no subbing layer under the dye layer.

C) Control dye-donor elements were prepared similar to A), except that the subbing layer was the following:

C-2 Poly(acrylonitrile-co-vinylidene chloride-co-acrylic acid) (14:79:7 wt ratio) (0.11, 0.22 and 0.43 g/m$^2$) coated from butanone.
C-3 Poly(vinyl alcohol) (0.11 g/m$^2$) coated from an aqueous solution.
C-4 Poly(vinyl acetate) (0.22 g/m$^2$) coated from butanone.
C-5 Poly(vinyl alcohol) (0.44 g/m$^2$) coated over a layer of the vinylidene chloride copolymer of C-2 (0.22 g/m$^2$) from an aqueous solution.
C-6 A mixture of poly(vinyl alcohol) and poly(vinyl acetate) (each 0.44 g/m$^2$) coated over a layer of the vinylidene chloride copolymer of C-2 (0.22 g/m$^2$) from an aqueous solution.
C-7 Methyl cellulose (0.44 g/m$^2$) coated over a layer of the vinylidene chloride copolymer of C-2 (0.22 g/m$^2$) from an acetone and water solvent.
C-8 Poly(n-butyl acrylate-co-2-aminoethyl methacrylate-co-2-hydroxyethyl methacrylate) (50:5:45 weight ratio) (0.11, 0.22 and 0.44 g/m$^2$) coated from an aqueous solution.

A dye-receiving element was prepared by coating the following layers in the order recited over a white reflective support of titanium dioxide-pigmented polyethylene overcoated paper stock:

1) A subbing layer of poly(acrylonitrile-co-vinylidene chloride-co-acrylic acid) (14:79:7 wt. ratio) (0.08 g/m$^2$) coated from 2-butanone;
2) A dye-receiving layer of Makrolon 5705®, a bisphenol A-polycarbonate resin (Bayer AG)(2.9 g/m$^2$), Tone PCL-300® polycaprolactone (Union Carbide)(0.38 g/m$^2$), and 1,4-didecoxy-2,6-dimethoxyphenol (0.38 g/m$^2$) coated from methylene chloride; and
3) Overcoat layer of Tone PCL-300® polycaprolactone (Union Carbide)(0.11 g/m$^2$), FC-431® fluocarbon surfactant (3M Corp.) (0.016 g/m$^2$) and DC-510® Silicone Fluid (Dow Corning)(0.016 g/m$^2$) coated from methylene chloride.

The dye-side of a dye-donor element strip approximately 10 cm × 13 cm in area was placed in contact with the image-receiver layer side of a dye-receiver element of the same area. This assemblage was clamped to a stepper-motor driven 60 mm diameter rubber roller. A TDK Thermal Head L-231 (thermostatted at 23.5° C.) was pressed with a spring at a force of 36 N against the dye-donor element side of the assemblage pushing it against the rubber roller.

The imaging electronics were activated causing the donor-receiver assemblage to be drawn through the printing head/roller nip at 6.9 mm/sec. Coincidentally the resistive elements in the thermal print head were pulsed for 29 usec/pulse at 128 usec intervals during the 33 msec/dot printing time. A stepped density image was generated by incrementally increasing the number of pulses/dot from 0 to 255. The voltage supplied to the printing head was approximately 24.5 volts, resulting in an instantaneous peak power of 1.4 watts/dot and maximum total energy of 10.5 mJoules/dot.

The Status A blue maximum density of each of the stepped images was read and recorded.

Using the same area of receiver, a stepped image using an unused yellow dye donor area was recorded on top of the first stepped image. Note was made of any sticking when the donor was separated from the receiver. This was repeated for up to six printings of dye-donor onto the same receiver. Sticking of the donor to the receiver, and retention of part or all of the donor dye layer on the receiver indicated a poor adhesion and weak bond for the subbing layer. The number of transfers (up to 6) that could be made to the receiver before sticking occurred was also recorded.

The following results were obtained:

TABLE

| Subbing Layer | ($g/m^2$) | Number of Transfers | Status A - Blue Maximum Density |
|---|---|---|---|
| C-1 | (none) | 3 | 2.4 |
| C-2 | (0.11) | 6 | 2.2 |
| | (0.22) | 6 | 1.8 |
| | (0.43) | 6 | 1.4 |
| C-3 | (0.11) | 2 | 2.4 |
| C-4 | (0.22) | 1 | 2.3 |
| C-5 | (0.43) | 2 | 2.6 |
| C-6 | (0.43 each) | 2 | 2.0 |
| C-7 | (0.43) | 6 | 1.9 |
| C-8 | (0.11) | 6 | 2.4 |
| | (0.22) | 6 | 2.3 |
| | (0.43) | 6 | 2.0 |
| A | (0.11) | 6 | 2.4 |
| | (0.22) | 6 | 2.4 |
| | (0.43) | 6 | 2.3 |
| B | (0.11) | 6 | 2.4 |
| | (0.22) | 6 | 2.3 |
| | (0.43) | 6 | 2.1 |

The above results indicate that the dye-donor subbing layers of the invention (A and B) derived from vinyl alcohol-vinyl acetate copolymers are superior to prior art subbing layers as they produce both high density transfer and low sticking (high number of transfers) with lesser variation between coating levels. While some of the prior art subbing layers have high density and low sticking (C-7 and C-8), they are coated from aqueous solutions with the disadvantages noted earlier.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a poly(ethylene terephthalate) support having thereon, in order, a subbing layer and a dye layer comprising a dye dispersed in a cellulosic binder, the improvement wherein said subbing layer comprises a copolymer of vinyl alcohol and an alkyl ester of vinyl alcohol.

2. The element of claim 1 wherein said alkyl ester of vinyl alcohol is vinyl acetate.

3. The element of claim 1 wherein said copolymer has the following formula:

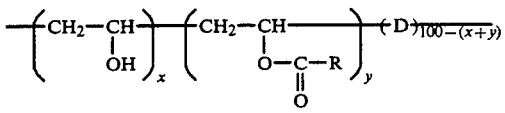

wherein:

R is a substituted or unsubstituted alkyl or alkylene group having from 1 to about 6 carbon atoms;

x is 5 to 25 mole percent;

y is 95 to 75 mole percent; and

D may be a copolymerizable monomer.

4. The element of claim 3 wherein x is 18 and y is 82, or x is 9 and y is 91.

5. The element of claim 1 wherein said dye layer comprises a sublimable dye dispersed in a cellulose mixed ester binder.

6. The element of claim 5 wherein said cellulose mixed ester is cellulose acetate propionate.

7. The element of claim 1 wherein the side of the support opposite the side having thereon said dye layer is coated with a slipping layer comprising a lubricating material.

8. The element of claim 1 wherein said dye layer comprises sequential repeating areas of cyan, magenta and yellow dye.

9. In a process of forming a dye transfer image comprising:

a) imagewise-heating a dye-donor element comprising a poly(ethylene terephthalate) support having thereon, in order, a subbing layer and a dye layer comprising a dye dispersed in a cellulosic binder, and b) transferring a dye image to a dye-receiving element to form said dye transfer image, the improvement wherein said subbing layer comprises a copolymer of vinyl alcohol and an alkyl ester of vinyl alcohol.

10. The process of claim 9 wherein said alkyl ester of vinyl alcohol is vinyl acetate.

11. The process of claim 9 wherein said copolymer has the following formula:

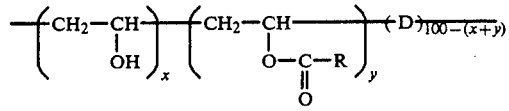

wherein:

R is a substituted or unsubstituted alkyl or alkylene group having from 1 to about 6 carbon atoms;

x is 5 to 25 mole percent;

y is 95 to 75 mole percent; and

D may be a copolymerizable monomer.

12. The process of claim 11 wherein x is 18 and y is 82, or x is 9 and y is 91.

13. The process of claim 9 wherein said support is coated with sequential repeating areas of cyan, magenta and yellow dye, and said process steps are sequentially performed for each color to obtain a three-color dye transfer image.

14. In a thermal dye transfer assemblage comprising:

a) a dye-donor element comprising a poly(ethylene terephthalate) support having thereon, in order, a subbing layer and a dye layer comprising a dye dispersed in a cellulosic binder, and b) a dye-receiving element comprising a support having thereon a dye image-receiving layer, said dye-receiving element being in a superposed relationship with said dye-donor element so that said dye layer is in contact with said dye image-receiving layer, the improvement wherein said subbing layer comprises a copolymer of vinyl alcohol and an alkyl ester of vinyl alcohol.

15. The asemblage of claim 14 wherein said alkyl ester of vinyl alcohol is vinyl acetate.

16. The assemblage of claim 14 wherein said copolymer has the following formula:

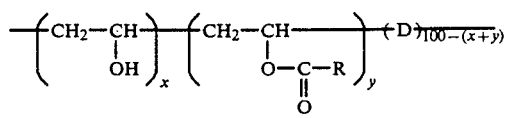

wherein:

R is a substituted or unsubstituted alkyl or alkylene group having from 1 to about 6 carbon atoms;

x is 5 to 25 mole percent;

y is 95 to 75 mole percent; and

D may be a copolymerizable monomer.

17. The assemblage of claim 16 wherein x is 18 and y is 82, or x is 9 and y is 91.

18. The assemblage of claim 14 wherein said dye layer comprises a sublimable dye dispersed in a cellulose mixed ester binder.

19. The assemblage of claim 18 wherein said cellulose mixed ester is cellulose acetate propionate.

20. The assemblage of claim 14 wherein the side of the support of the dye donor element opposite the side having thereon said dye layer is coated with a slipping layer comprising a lubricating material.

* * * * *